US009284749B2

(12) United States Patent
Vasudevan

(10) Patent No.: US 9,284,749 B2
(45) Date of Patent: Mar. 15, 2016

(54) DOOR LOCK ASSEMBLY

(75) Inventor: Sundar Raj Dore Vasudevan, Bangalore (IN)

(73) Assignee: Schlage Lock Company LLC, Indianapolis, IN (US)

( * ) Notice: Subject to any disclaimer, the term of this patent is extended or adjusted under 35 U.S.C. 154(b) by 735 days.

(21) Appl. No.: 13/448,858

(22) Filed: Apr. 17, 2012

(65) Prior Publication Data

US 2013/0269402 A1 Oct. 17, 2013

(51) Int. Cl.
*E05B 1/00* (2006.01)
*E05B 55/00* (2006.01)

(52) U.S. Cl.
CPC ..... *E05B 55/005* (2013.01); *Y10T 70/5531* (2015.04); *Y10T 292/0997* (2013.01); *Y10T 292/1016* (2015.04); *Y10T 292/1022* (2015.04)

(58) Field of Classification Search
CPC ..... E05B 55/005; E05B 15/0053; Y10T 292/0997; Y10T 292/1016; Y10T 292/1022; Y10T 70/5531
USPC ..... 292/347, 137, 163, 169, 348, DIG. 37; 70/221–224, 468, 472, 481
See application file for complete search history.

(56) References Cited

U.S. PATENT DOCUMENTS 2,184,875 A 12/1939 Schlage
2,662,387 A * 12/1953 Gotthard Hagstrom ..... 70/472
3,121,319 A 2/1964 Webster
3,621,685 A * 11/1971 Sargent ..... E05B 59/00 292/39
4,470,279 A * 9/1984 Neary et al. ..... 70/134
5,232,255 A * 8/1993 Palmer et al. ..... 292/336.3
5,460,417 A 10/1995 Zuckerman
5,816,086 A 10/1998 Russell, IV
6,223,567 B1 5/2001 Fadul
6,860,529 B2 3/2005 Chong et al.
6,929,290 B2 * 8/2005 Don ..... 292/169
7,934,754 B2 5/2011 Mathachan
2002/0117867 A1 8/2002 Bates et al.
2004/0237608 A1 12/2004 Chen
2008/0216528 A1 9/2008 Sun et al.
2009/0056391 A1 * 3/2009 Mathachan ..... 70/91
2009/0056392 A1 3/2009 Brannaman et al.

FOREIGN PATENT DOCUMENTS

KR 20-1991-0006253 8/1991
KR 20-0447937 3/2010

OTHER PUBLICATIONS

PCT/US2013/036078 International Search Report and Written Opinion dated Jun. 28, 2013 (10 pages).

* cited by examiner

*Primary Examiner* — Kristina Fulton
*Assistant Examiner* — Christine M Mills
(74) *Attorney, Agent, or Firm* — Michael Best & Friedrich LLP

(57) ABSTRACT

A lock assembly that includes an interior locking actuator, a biasing member that biases the interior locking actuator toward an unlocked position, a retaining member that retains the interior locking actuator in a locked position, and a driver rotatable from a locked position to an unlocked. The interior locking actuator is manually pushed and manually rotated to move the interior locking actuator from the unlocked position to the locked position. When the interior locking actuator is in the locked position, movement of the interior handle to retract a latch causes the biasing member to move the interior locking actuator toward the unlocked position.

19 Claims, 7 Drawing Sheets

DOOR LOCK ASSEMBLY

BACKGROUND

The present invention relates to locks, and more particularly to tubular locks for doors.

Door locks typically include an interior assembly, an exterior assembly, and a latch assembly. When the door is closed the latch assembly engages a pocket or recess formed in a frame of the door to hold the door in the closed position. Generally, in tubular lock assemblies the interior and exterior assemblies both include a handle that is rotatable to retract the latch so that the door can be opened. Often, the interior assembly further includes a locking actuator having a push button or a turn button that is manually operable to lock the lock assembly. When the lock assembly is locked, the exterior handle is inoperable to retract the latch and the door cannot be opened using the exterior handle.

SUMMARY

In one embodiment, the invention provides a lock assembly for use with a latch movable from an extended position to a retracted position. The lock assembly includes an interior handle manually operable to move the latch from the extended position to the retracted position, an interior locking actuator manually movable from an unlocked position to a locked position, a biasing member that biases the interior locking actuator toward the unlocked position, a retaining member that retains the interior locking actuator in the locked position against the bias of the biasing member, an exterior handle, and a driver rotatable from a locked position to an unlocked position such that the exterior handle is manually operable to retract the latch when the driver is in the unlocked position and the exterior handle is inoperable to retract the latch when the driver is in the locked position. The interior locking actuator is manually pushed and manually rotated to move the interior locking actuator from the unlocked position to the locked position. When the interior locking actuator is in the locked position, movement of the interior handle to retract the latch causes the biasing member to move the interior locking actuator toward the unlocked position.

In another embodiment the invention provides a lock assembly for use with a latch movable from an extended position to a retracted position. The lock assembly includes a driver rotatable from a locked position to an unlocked position, an exterior handle manually operable to move the latch from the extended position to the retracted position when the driver is in the unlocked position and inoperable to move the latch when the driver is in the locked position, and an exterior locking actuator coupled to the driver. The exterior locking actuator is operable to rotate the driver from the locked position toward the unlocked position. The lock assembly further includes an interior handle manually operable to move the latch from the extended position to the retracted position, an interior locking actuator coupled for rotation with the driver and the interior locking actuator is manually movable from an unlocked position to a locked position and operable to rotate the driver from the unlocked position to the locked position. The lock assembly further includes a first biasing member that biases the interior locking actuator in a direction from the exterior handle toward the interior handle, a second biasing member that rotationally biases the interior locking actuator with respect to the interior handle toward the unlocked position, and a retaining member that retains the interior locking actuator in the locked position against the bias of the first biasing member and the bias of the second biasing member.

Rotation of the driver from the locked position to the unlocked position by the exterior locking actuator disengages the retaining member such that the first biasing member moves the interior locking actuator in the direction from the exterior handle toward the interior handle and the second biasing member rotates the interior locking actuator to push and rotate the interior locking actuator from the locked position to the unlocked position.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
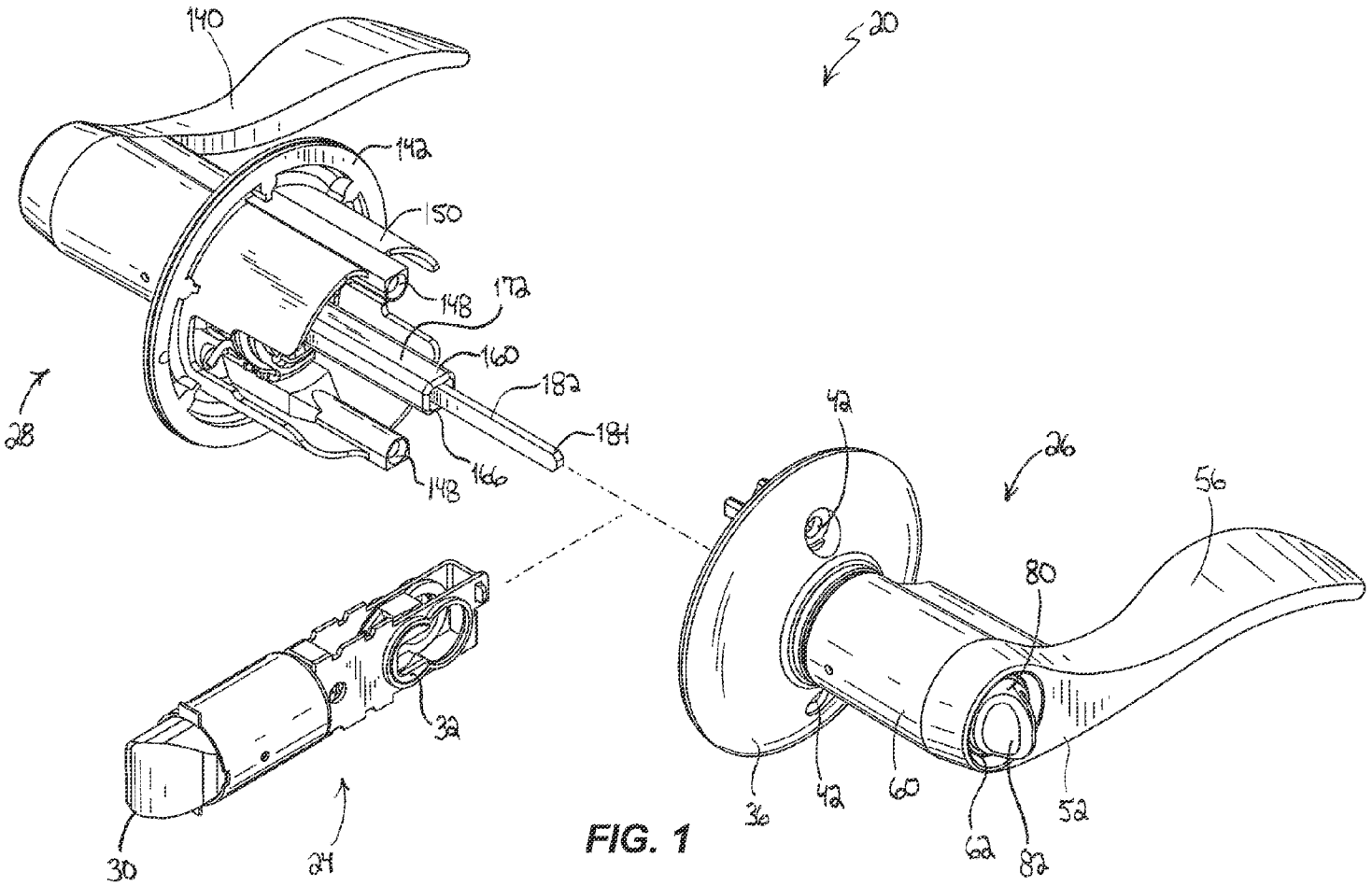
FIG. 1 is a partially exploded view of a lock assembly according to one embodiment of the invention.

FIG. 1 illustrates a lock assembly 20. The illustrated lock assembly 20 is a tubular lock assembly for use with a door (not illustrated). The lock assembly 20 includes a latch assembly 24, an interior assembly 26, and an exterior assembly 28. The exterior assembly 28 is coupled to and extends from an exterior surface of the door and the interior assembly 26 is coupled to and extends from an interior surface of the door. The latch assembly 24 includes a latch 30 movable from an extended position to a retracted position using the interior and exterior assemblies 26 and 28. A latch actuator 32 of the latch assembly 24 is rotatable to retract the latch 30. The latch assembly 24 is located between the exterior assembly 28 and the interior assembly 26 in a bore of the door such that the latch 30 engages a pocket, often defined by a strike plate, in a frame of the door to hold the door in the closed position.

Figure 4:
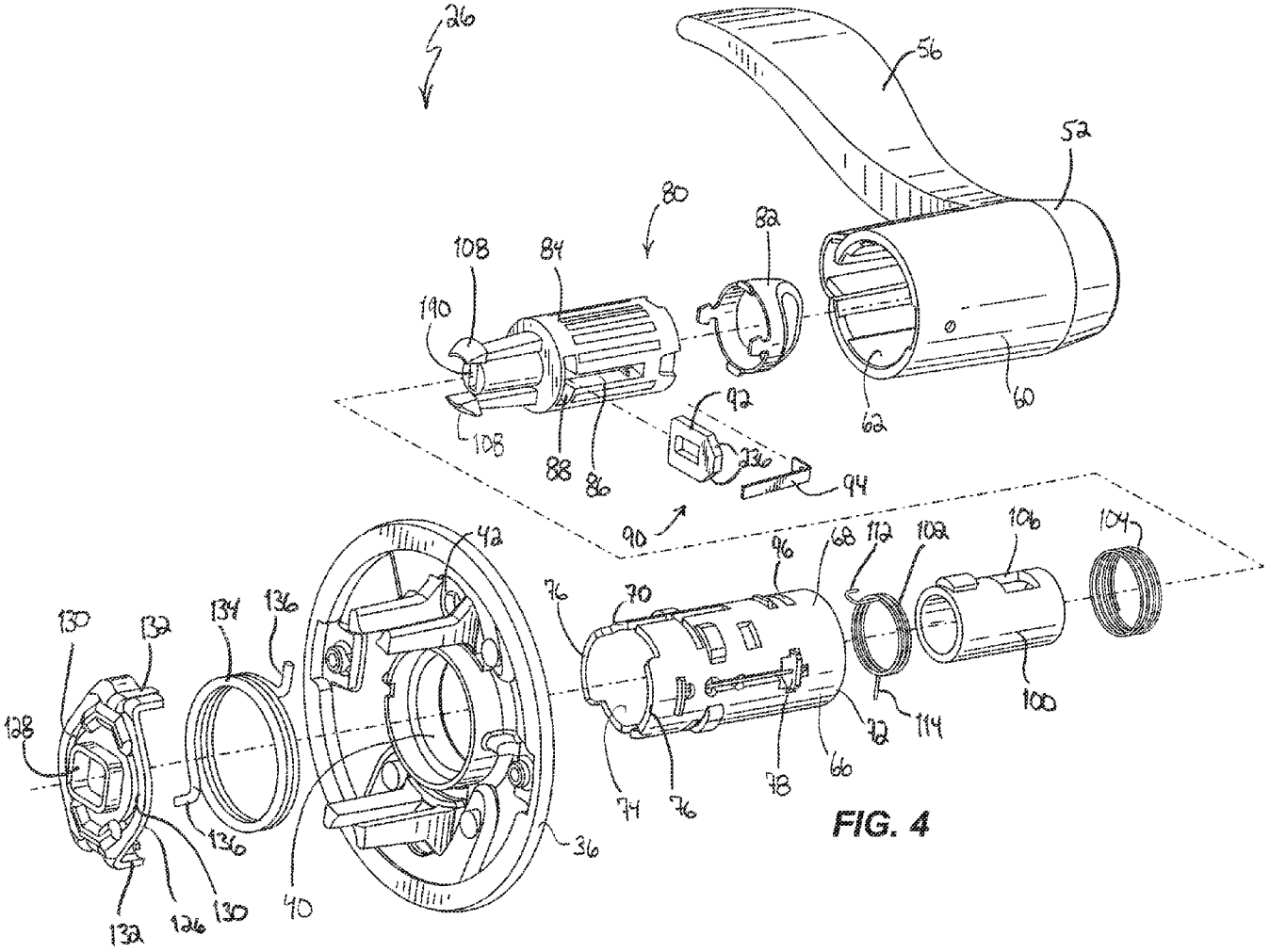
FIG. 4 is an exploded view of an interior assembly of the lock assembly of FIG. 1.

Referring to FIGS. 1 and 4, the interior assembly 26 includes an interior chassis 36. The interior chassis 36 couples to the door such that the interior chassis 36 is generally fixed with respect to the door. The interior chassis 36 includes a handle receiving aperture 40 that extends through the interior chassis 36. Fastener receiving apertures 42 also extend through the interior chassis 36. A fastener (not shown) extends through each of the fastener receiving apertures 42 to couple the interior chassis 36 to the door and to the exterior assembly 28 (FIG. 1).

With continued reference to FIGS. 1 and 4, an interior handle 52 is coupled to the interior chassis 36 for rotation with respect to the interior chassis 36. The interior handle 52 includes an interior handle portion 56 and a locking actuator receiving portion 60. The locking actuator receiving portion 60 defines an aperture 62. The handle portion 56 is configured to be grasped by a user of the lock assembly 20 to manually rotate the interior handle 52 to retract the latch 30. The illustrated interior handle 52 is just one possible construction of the interior handle, and in other constructions the interior handle can take other suitable forms, such as round knobs and the like.

Referring to FIG. 4, a hollow interior spindle 66 is partially received within the locking member receiving aperture 62 of the interior handle 52. The interior spindle 66 includes a generally cylindrical outer wall portion 68 that defines an interior end portion 70, an exterior end portion 72, and an aperture 74 that extends longitudinally through the center of the outer wall portion 68 from the interior end portion 70 to the exterior end portion 72. The outer wall portion 68 further includes retraction member engaging projections 76 that extend from the interior end portion 70. When the interior assembly 26 is assembled, the spindle 66 is received in the aperture 62 of the interior handle 52 and the spindle 66 is coupled for co-rotation with the interior handle 52 relative to the chassis 36 via a clip 78.

The interior assembly 26 further includes an interior locking actuator 80 that is manually pushed and rotated by a user from an unlocked position to a locked position. The interior locking actuator 80 includes a button 82 that extends from the interior handle 52 when the interior assembly 26 is assembled (see FIG. 1) and the button 82 is partially disposed within the locking actuator receiving aperture 62 of the interior handle 52.

With continued reference to FIG. 4, the locking actuator 80 further includes a body portion 84 coupled to and substantially fixed with respect to the button 82. The body portion 84 is received within the longitudinal aperture 74 of the interior spindle 66 such that the body portion 84 is movable with respect to the interior spindle 66. The body portion 84 defines a cavity 86 and a retaining member slot 88 connected to the cavity 86.

Figure 7:
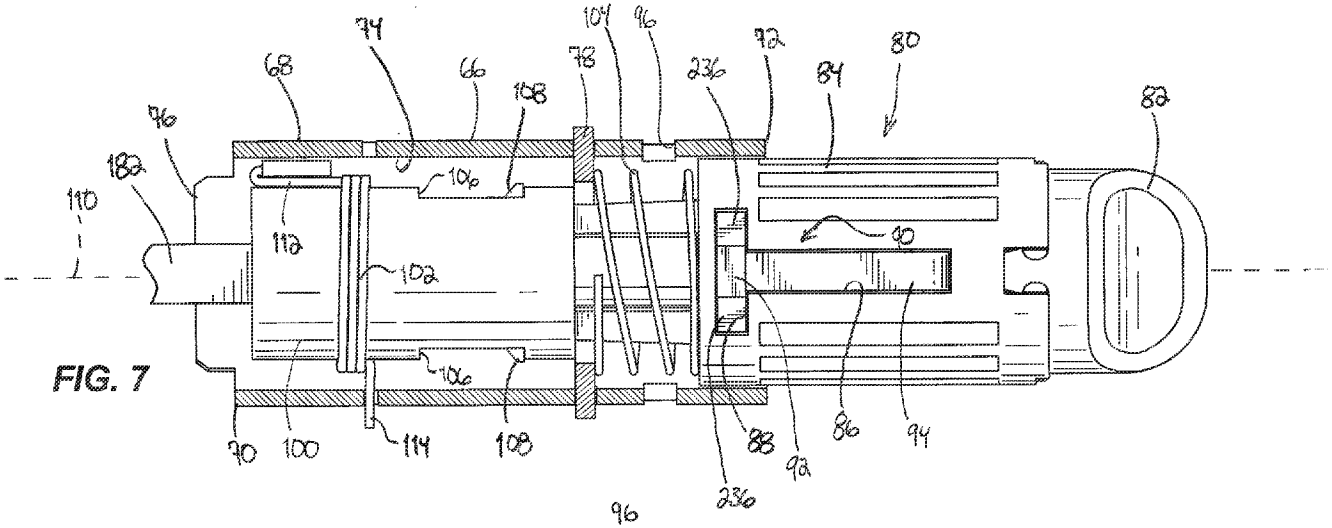
FIG. 7 is a partial cross-sectional side view of a portion of the lock assembly of FIG. 1 in an unlocked position.
Figure 8:
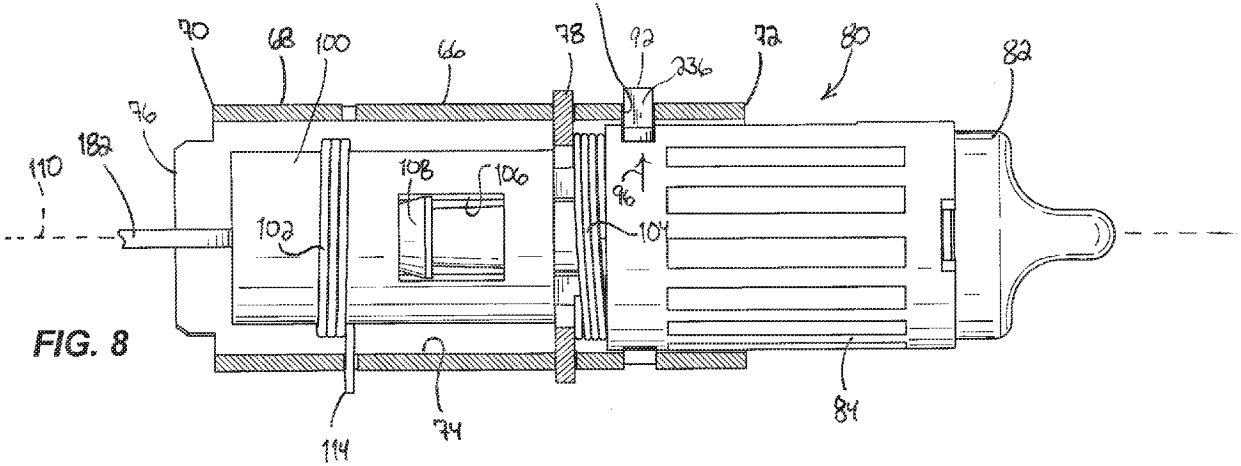
FIG. 8 is a partial cross-sectional side view of the portion of the lock assembly of FIG. 7 in a locked position.

A retaining member 90 is disposed within the cavity 86. The illustrated retaining member 90 includes a tab 92 and a biasing member 94, which is a leaf spring in the illustrated embodiment. The tab 92 extends through the retaining member slot 88 of the body portion 84. As illustrated in FIGS. 7 and 8, and as will be discussed in more detail below, a portion of the tab 92 is selectively extendable through a retaining member receiving aperture 96 of the interior spindle 66 to retain the interior actuator 80 in the locked position (FIG. 8). The spring 94 biases the tab 92 outward through the retaining member slot 88 (in the direction of arrow 96 in FIG. 8) to releasably retain the interior actuator 80 in the locked position.

Referring to FIG. 4, the interior locking actuator 80 further includes a biasing member support 100, a first biasing member 102, and a second biasing member 104. Referring to FIGS. 7 and 8, the support 100 is generally cylindrical and is received in the aperture 74 of the spindle 66. The support 100 includes elongated apertures 106 that receive tabs 108 of the actuator body 84 to couple the support 100 and the body 84. The tabs 108 and the apertures 106 are sized so that the body 84 can slide with respect to the support 100 along an axis 110 but yet the body 84 and the support 100 are coupled for co-rotation about the axis 110 relative to the chassis 36 and the handle 52.

The first biasing member 102, which is a torsion spring in the illustrated embodiment, includes a first end 112 connected to the support 100 and a second end 114 connected to the spindle 66. The torsion spring 102 rotationally biases the body 84 and the support 100 about the axis 110 in the direction of arrow 116 of FIG. 5. The second biasing member 104, which is a coil spring in the illustrated embodiment, is located between the body 84 and the clip 78, and the spring 104 biases the body portion 84 along the axis 110 in the direction of arrow 118 in FIG. 7.

Referring to FIG. 4, the interior assembly 26 further includes a latch retractor 126. The latch retractor 126 includes a centrally located square aperture 128 and arcuate apertures 130 that partially surround the square aperture 128. The arcuate apertures 130 each receive a respective retraction member engaging projection 76 of the interior spindle 66 to couple the latch retractor 126 and the interior spindle 66 for co-rotation. The latch retractor 126 further includes tabs 132. A torsion spring 134 having ends 136 is coupled to the latch retractor 126 so that each end 136 of the spring 134 contacts one of the tabs 132 of the latch refractor to rotationally bias the latch retractor 126 and the interior handle 52 relative to the interior chassis 36.

Figure 2:
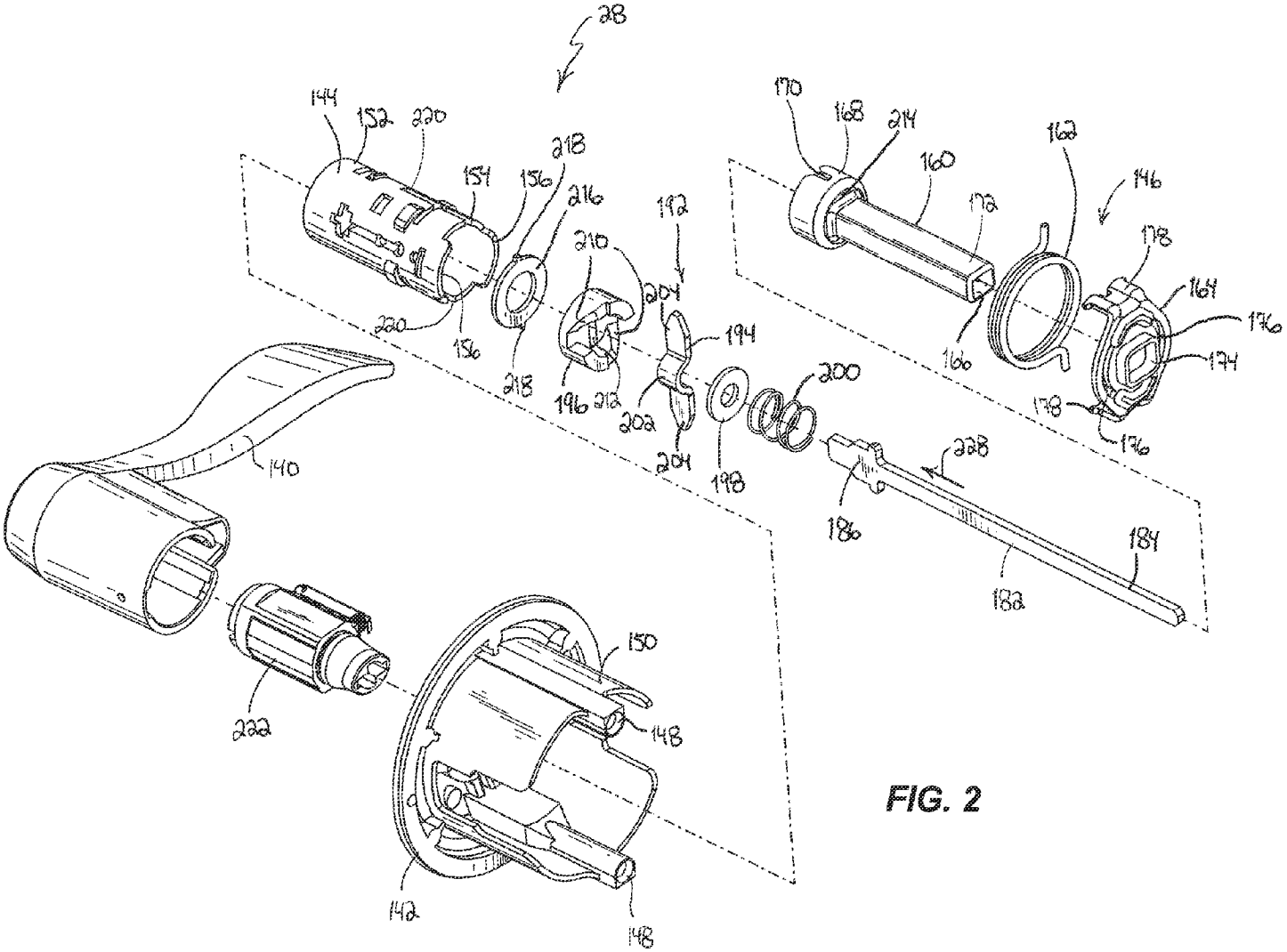
FIG. 2 is an exploded view of an exterior assembly of the lock assembly of FIG. 1.

Referring to FIG. 2, the exterior assembly 28 includes an exterior handle 140, an exterior chassis 142, an exterior spindle 144, and an exterior latch refractor assembly 146. The exterior chassis 142 includes mounting apertures 148 that receive fasteners to couple the exterior assembly 28 to the door and to the interior assembly 26 (FIG. 1). The exterior chassis 142 further includes a cylindrical portion 150 that is received in a bore of the door to couple the chassis 142 to the door.

The exterior spindle 144 is substantially cylindrical and hollow and includes a first or outer end portion 152 and a second or inner end portion 154. While not visible in FIG. 2, the chassis 142 includes a central aperture through which the outer end portion 152 of the spindle 144 extends when the exterior assembly 28 is assembled. The exterior handle 140 is coupled to the exterior spindle 144 adjacent the outer end portion 152 of the exterior spindle 144 such that the exterior handle 140 and the exterior spindle 144 are coupled for rotation together with respect to the exterior chassis 142. The inner end portion 154 of the spindle 144 includes arcuate projections 156 that extend from the inner end portion 154 of the exterior spindle 144.

The exterior latch retractor assembly 146 includes a latch actuator or tube 160, an exterior handle biasing member 162, and a latch retractor 164. The tube 160 defines a tube aperture 166 and an enlarged hollow end portion 168 having a slot 170. An inner end portion 172 of the tube 160 has a non-circular and substantially square cross-section. While only one slot 170 is visible in FIG. 2, the tube 160 includes a second slot directly across from the visible slot 170 in the enlarged end portion 168 of the tube 160.

The latch retractor 164 includes a tube receiving aperture 174, spindle receiving apertures 176, and tabs 178. The tube receiving aperture 174 has a shape that is complimentary to the inner end portion 172 of the tube 160 and is sized such that the inner end portion 172 of the tube 160 can extend through the tube receiving aperture 174, and yet rotation of the latch retractor 164 will rotate the tube 160. The spindle receiving apertures 176 are arcuate apertures that partially surround the tube receiving aperture 174. The spindle receiving aperture 176 are complimentary to the arcuate projections 156 of the inner end portion 154 of the spindle 144. The arcuate apertures 176 of the latch retractor 164 each receive one of the arcuate projections 156 of the spindle 144 such that rotation of the spindle 144 via the handle 140 produces a corresponding rotation of the latch retractor 164. Rotation of the latch retractor 164 rotates the tube 160 and rotation of the tube 160 rotates the latch actuator 32 to retract the latch 30 (FIG. 1). The exterior handle biasing member 162, which is a torsion spring in the illustrated construction, is directly coupled to the chassis 142 and to the exterior latch refractor 164 using the tabs 178 of the latch retractor 164. The exterior handle spring 162 rotationally biases the exterior handle 140 into the position illustrated in FIG. 1.

Referring to FIG. 2, the exterior assembly 28 further includes a driver 182. The driver 182 includes an elongated portion 184 and an enlarged end portion 186. When the exterior assembly 28 is assembled, the elongated portion 184 of the driver 182 extends through the aperture 166 of the tube 160, and the driver 182 is free to rotate with respect to the tube 160. The end portion 184 of the driver 182 extends into an aperture 190 (FIG. 4) of the body 84 of the interior locking actuator 80 to couple the interior locking actuator 80 and the driver 182 for co-rotation relative to the interior chassis 36 and the exterior chassis 142.

With continued reference to FIG. 2, the exterior assembly 28 further includes an exterior handle locking assembly 192. The exterior handle locking assembly 192 includes an exterior handle locking member 194, a cam member 196, a washer 198, and a biasing member or spring 200. The exterior handle locking member 194 defines a half cylinder portion 202 and includes projections or ears 204. When the exterior assembly 28 is assembled, the half cylinder portion 202 of the exterior handle locking member 194 partially surrounds the driver 182. The exterior handle locking member 194 is able to translate with respect to the driver 182 while the driver 182 generally does not rotate the exterior handle locking member 194 (i.e., the driver 70 rotates with respect to the exterior handle locking member 194).

Referring to FIG. 2, the cam 196 includes cam ramps 210 that correspond to the ears 204 of the exterior handle locking member 194. Thus, when the exterior assembly 28 is assembled, each ear 204 will travel along a respective ramp 210 of the cam member 196. The cam member 196 further includes a cam member aperture 212. The cam member aperture 212 is generally rectangular in shape and complements the cross-sectional shape of the elongated portion 184 of the driver 182. Therefore, the cam member aperture 212 couples the cam member 196 to the driver 182 such that the cam member 196 rotates with the driver 182.

The spring 200 of the exterior handle locking assembly 192 is a coil spring in the illustrated embodiment. When the exterior assembly 28 is assembled, the spring 200 is partially received in the enlarged end portion 168 of the tube 160. The spring 200 acts against a flange 214 defined by the end portion 168 of the tube 160 and against the washer 198 to bias the exterior handle locking member 194 along the driver 182. A cam support plate 216 is utilized to support the cam member 196 against the force of the spring 200. The cam support plate 216 includes projections 218. The projections 218 are received by longitudinal slots 220 of the exterior spindle 144 to couple the cam support plate 216 to the spindle 144 for co-rotation with the spindle 144.

The exterior assembly 28 further includes an exterior lock actuator 222. In the illustrated embodiment, the exterior lock actuator 222 is a lock cylinder configured to receive a key. The lock cylinder 222 is operable, via the key, to rotate the driver 182.

It should be understood that the illustrated exterior handle 140 is just one possible construction of the exterior handle 140 and in other embodiments the exterior handle may take other suitable forms, such as conventional round knobs, levers, and the like.

Figure 5:
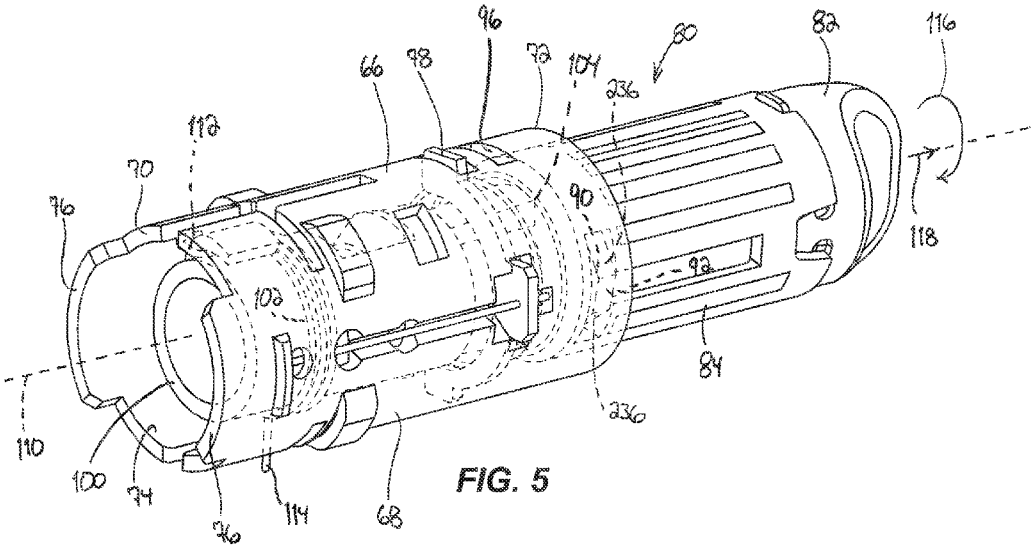
FIG. 5 is a perspective view of a portion of the interior assembly of FIG. 4 in an unlocked position.

In operation, referring to FIGS. 1 and 5, when the button 82 of the interior locking actuator 80 is in the unlocked position, as illustrated in FIGS. 1, 5, and 7, a user can manually rotate either the interior handle 52 or the exterior handle 140 to retract the latch 30 in order to open the door. Referring to FIGS. 1 and 2, rotation of the exterior handle 140 rotates the exterior spindle 144, which rotates the exterior latch refractor 164, thereby rotating the tube 160. Rotation of the tube 160, which is engaged with the latch actuator 32, retracts the latch 30. When the latch 30 is retracted, the user is able to open the door. Referring to FIG. 4, similarly, rotation of the interior handle 52 rotates the interior spindle 66, which rotates the interior latch retractor 126, thereby rotating the tube 160 (FIG. 2) to retract the latch 30.

Figure 6:
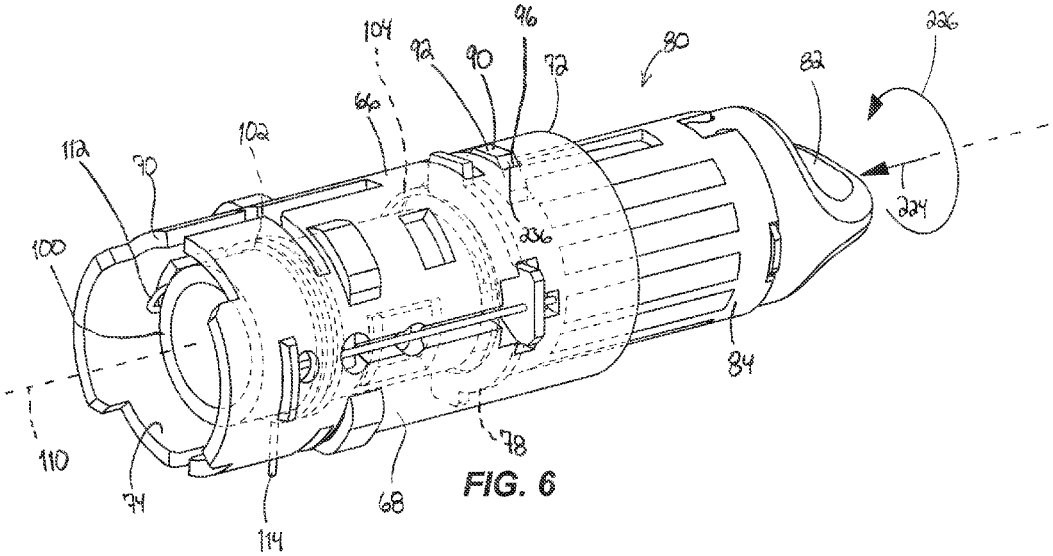
FIG. 6 is a perspective view of the portion of the lock assembly of FIG. 5 in a locked position.

The user can lock the lock assembly 20 from the interior assembly 26 by using the interior locking actuator 80. When the lock assembly 20 is locked, the exterior handle 140 is inoperable to retract the latch 30. FIGS. 5 and 7 illustrate the interior locking actuator 80 in the unlocked position. FIGS. 6 and 8 illustrate the interior locking actuator 80 in the locked position. To lock the lock assembly 20, the locking actuator 80 is both pushed and rotated to move the locking actuator 80 from the unlocked position to the locked position. Pushing the button 82 moves the button 82 and the body 84 with respect to the spindle 66 in the direction of arrow 224 of FIG. 6. Also, the user manually rotates the locking actuator 80 with respect to the spindle 66 in the direction of arrow 226 of FIG. 6. Therefore, to move the locking actuator 80 from the unlocked position (FIGS. 5 and 7) to the locked position (FIGS. 6 and 8), the user both pushes the button 82 and rotates the button 82 with respect to the spindle 66 and the interior handle 52.

Referring to FIGS. 6 and 8, when the locking actuator 80 reaches the locked position, the tab 92 of the retaining member 90 is aligned with the retaining member aperture 96 of the interior spindle 66 and the spring 94 forces the tab 92 to extend into the retaining member aperture 96. In the position illustrated in FIGS. 6 and 8, the retaining member 90 retains the locking actuator 80 in the locked position against the rotational bias in the direction of the arrow 116 (FIG. 5) about the axis 110 caused by the spring 102 and against the bias along the axis 110 in the direction of arrow 118 (FIG. 5) caused by the spring 104.

Referring to FIG. 2, when the locking actuator 80 is in the unlocked position, the driver 182 is also in an unlocked position because the locking actuator 80 and the driver 182 are coupled for co-rotation via aperture 190 (FIG. 4) and the driver 182 rotates between the unlocked position (FIG. 7) and the locked position (FIG. 8) with the interior locking actuator 80. When the locking actuator 80 is moved to the locked position, the driver 182 is rotated to the locked position (FIG. 8). When the driver 182 rotates from the unlocked position (FIG. 7) to the locked position (FIG. 8) the cam 196 (FIG. 2) also rotates with the driver 182. Referring to FIG. 2, such rotation of the cam 196 causes the locking member 194 to move along the driver 182 in the direction of arrow 228 of FIG. 2 because of the position of the ramps 210 and the spring 200 acting against the locking member 194, which pushes the locking member 194 in the direction of arrow 228. Therefore, the locking member 194 moves out of the slots 170 of the tube 160 and into the slots 232 (FIG. 3) of the exterior chassis 142.

Figure 3:
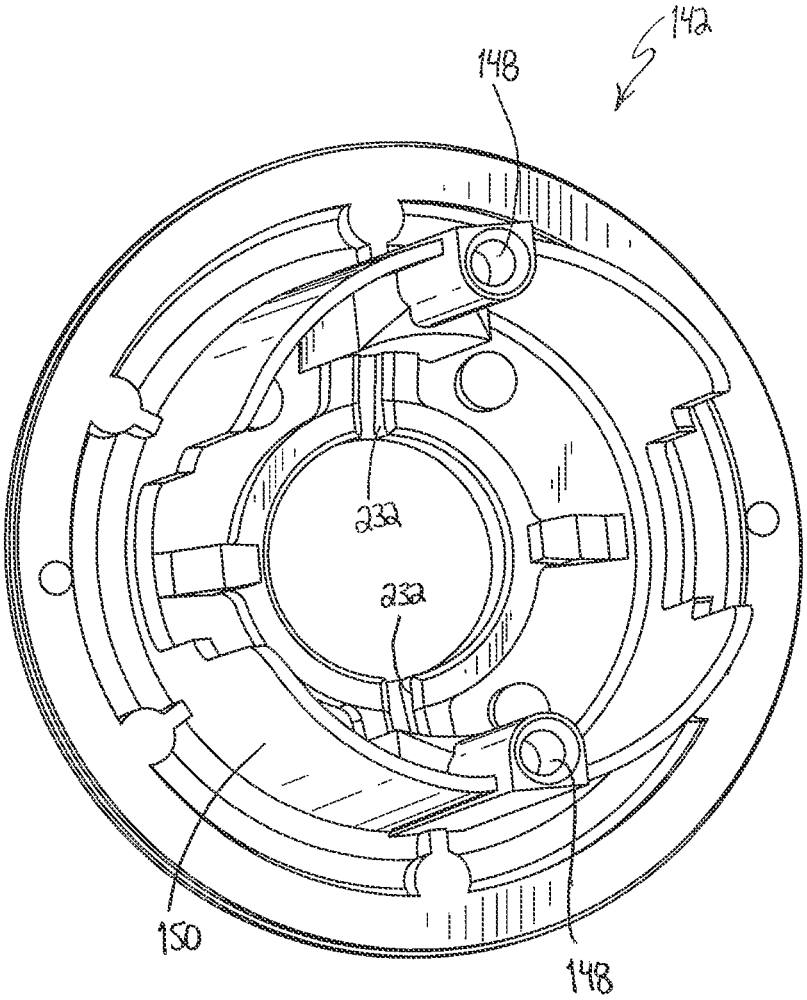
FIG. 3 is a perspective view of a chassis of the exterior assembly of FIG. 2.

Referring to FIGS. 2 and 3, in the locked position, the exterior handle locking member 194 extends through the elongated slot 220 of the exterior spindle 144 and the exterior handle locking member 194 is received within slots 232 of the exterior chassis 142. Therefore, when the locking member 192 is in the locked position, the exterior spindle 144 is coupled to the exterior chassis 142 using the locking member 194 such that the exterior spindle 144 generally cannot rotate with respect to the exterior chassis 142. The exterior handle 140 is coupled for rotation with the exterior spindle 144, and therefore, when the exterior handle locking member 194 is in the locked position, the exterior handle 140 cannot rotate with respect to the chassis 142 to retract the latch 30 (FIG. 1).

Referring to FIG. 2, the driver 182 can also be rotated between the locked and unlocked positions using a key that is received within the lock cylinder 222. The key can be rotated to rotate the driver 182. Rotation of the driver 182 from the locked position (FIG. 8) toward the unlocked position (FIG. 7) also rotates the interior locking actuator 80 because the driver 182 is received in the aperture 190 (FIG. 4) of the locking actuator 80. Rotation of the locking actuator 80 causes rotation of the retaining member 90, and therefore, rotation of the driver 182 from the locked position toward the unlocked position causes the retaining member 90 to rotate relative to the spindle 66. Such rotation cause ramps 236 (FIG. 4) of the tab 92 to cam against the spindle 66, which causes the tab 92 to move against the bias of spring 94 and out of the aperture 96 of the spindle 66. With the tab 92 no longer engaged in the aperture 96 of the spindle 66, the torsion spring 102 rotates the locking actuator 80 in the direction of arrow 116 of FIG. 5 toward the unlocked position while the spring 104 moves the locking actuator 80 in the direction of arrow 118 along the axis 110 toward the unlocked position (FIG. 5).

Rotation of the driver 182 from the locked position (FIG. 8) to the unlocked position (FIG. 7) rotates the cam 196 (FIG. 2), which causes the ramps 210 to move with respect to the ears 204 of the locking member 194. Such movement of the rams 210 forces the locking member 194 to move along the driver 182 against the bias of the spring 200 and out of the slots 232 (FIG. 3) of the chassis 142 and into the slots 170 of the tube 160. With the ears 204 no longer in the slots 232 of the chassis 142, the user is free to rotate the exterior handle 140 to retract the latch 30.

Referring to FIGS. 1 and 8, the lock assembly 20 can also be unlocked by rotating the interior handle 52. As discussed above, rotation of the interior handle 52 to rotates the interior spindle 66. When the interior locking actuator 80 is in the locked position (FIG. 8), rotation of the interior handle 52 rotates the interior spindle 66 which causes the interior spindle 66 to cam against the ramps 236 of the retaining member tab 92. Continued rotation of the spindle 66 via the handle 52 forces the tab 92 to move out of the aperture 96 in the spindle 66 against the bias of the spring 94. As discussed above, with the retaining member 90 no longer interconnecting the locking actuator 80 and the interior spindle 66 (FIG. 7), the spring 102 rotates the locking actuator 80 in the direction of arrow 116 of FIG. 5 about the axis 110 while the spring 104 moves the locking actuator 80 along the axis 110 in the direction of arrow 118 of FIG. 5 to both push and rotate the locking actuator 80 to the unlocked position. Continued rotation of the interior handle 52 retracts the latch 30 to allow the user to exit the door. Therefore, the user can open the door by rotating the interior handle 52 when the lock assembly 20 is locked (i.e., 'emergency egress') and the lock assembly 20 becomes unlocked when the user rotates the interior handle 52 to retract the latch 30, thereby providing a non-lockout feature. Also, the lock assembly 20 includes the interior locking actuator 80 that is both pushed and turned to move between the locked and the unlocked positions, which has been found to provide a relatively secure and reliable mechanism for locking and unlocking the assembly 20.

Figure 9:
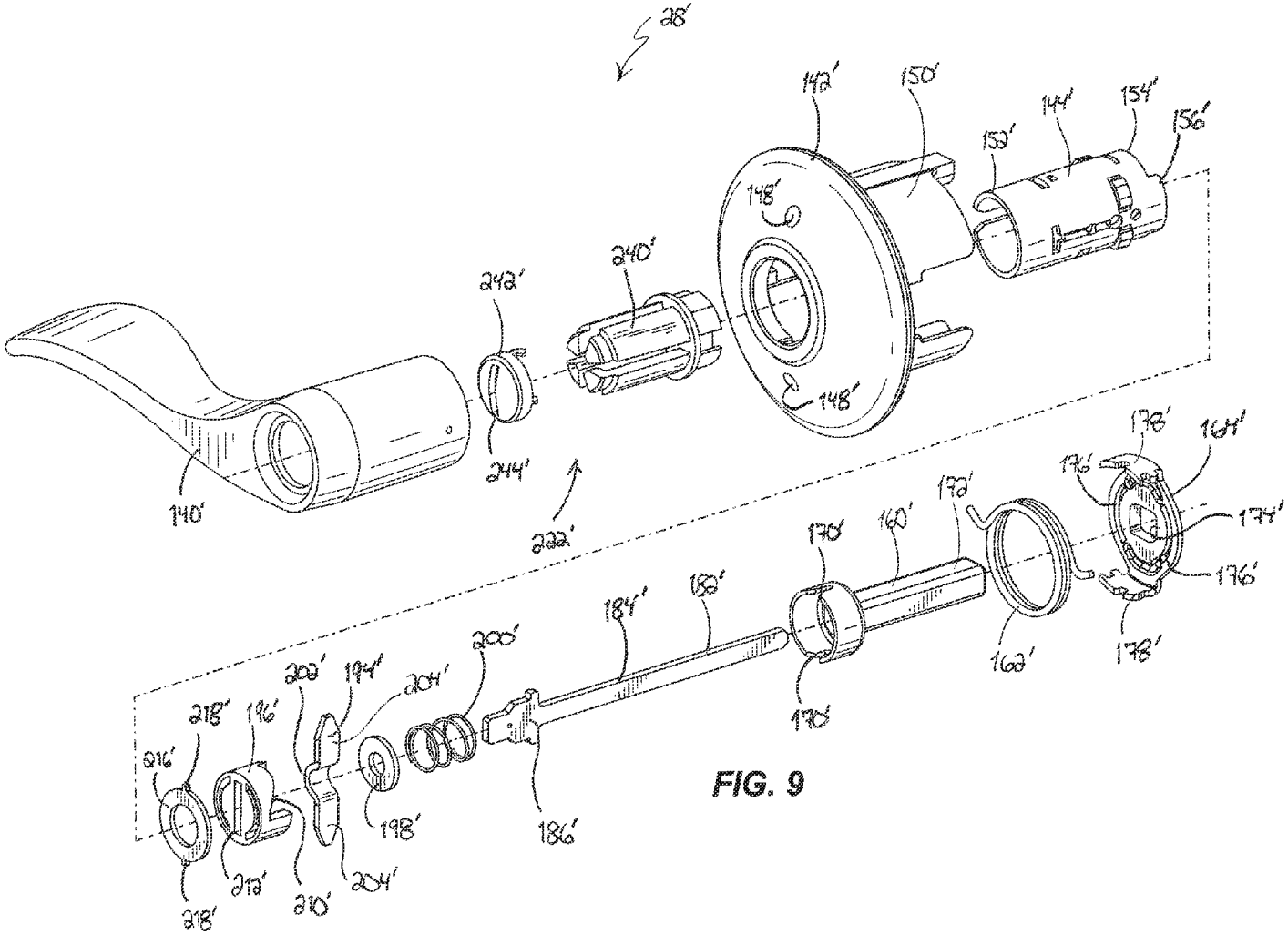
FIG. 9 is an exploded view of an exterior assembly of a lock assembly according to another embodiment of the invention.

FIG. 9 illustrates an exterior assembly 28' for use with the interior assembly 26 and the latch assembly 24 discussed above with respect to FIGS. 1-8 according to another embodiment of the invention. The exterior assembly 28' can be used in place of the exterior assembly 28 discussed above. The exterior assembly 28' is similar to the exterior assembly 28 discussed above with regard to FIGS. 1-8 and therefore like components have been given like reference numbers with the addition of a prime symbol and only differences between the exterior assembly 28' and the exterior assembly 28 will be discussed in detail. The exterior assembly 28' includes an exterior lock actuator 222' that includes a base 240' and a cover 242'. The base 240' and the cover 242' are coupled to the driver 182' for rotation with the driver 182'. The cover 242' includes a slot 244'. In operation, the user can insert a coin, screwdriver, or the like into the slot 244' to rotate the driver 182' to unlock the exterior assembly 28'. Therefore, the exterior assembly 28' is a privacy type lock assembly that does not include a lock cylinder and key arrangement like the lock cylinder 222 of the exterior assembly 28 of the door lock assembly 20 of FIG. 1-8. The interior assembly 26, discussed above with regard to FIGS. 1-8, can be used with either a privacy type lock (FIG. 9) or an entrance type lock (i.e., lock cylinder and key—FIGS. 1-8).

Various features and advantages of the invention are set forth in the following claims.

The invention claimed is:

1. A lock assembly for use with a latch movable from an extended position to a retracted position, the lock assembly comprising:

an interior handle manually operable to move the latch from the extended position to the retracted position;

an interior locking actuator located on an exterior of the interior handle, the interior locking actuator manually movable from an unlocked position to a locked position;

a biasing member that biases the interior locking actuator toward the unlocked position;

a retaining member that retains the interior locking actuator in the locked position against the bias of the biasing member;

an exterior handle;

a driver rotatable from a locked position to an unlocked position such that the exterior handle is manually operable to retract the latch when the driver is in the unlocked position and the exterior handle is inoperable to retract the latch when the driver is in the locked position; and an interior spindle rotatable with the interior handle to move the latch from the extended position to the retracted position, wherein the interior locking actuator is manually pushed and manually rotated to move the locking actuator from the unlocked position to the locked position, wherein when the interior locking actuator is in the locked position, movement of the interior handle to retract the latch causes the biasing member to move the interior locking actuator toward the unlocked position, wherein the retaining member engages the interior locking actuator and the interior spindle to retain the interior locking actuator in the locked position, wherein rotation of the interior handle disengages the retaining member from the interior locking actuator and the interior spindle to allow the biasing member to move the interior locking actuator toward the unlocked position, wherein the interior spindle is generally cylindrical, and wherein the retaining member is at least partially located within the interior spindle.

2. The lock assembly of claim 1, wherein the interior locking actuator is pushed in a direction from the interior handle toward the exterior handle to move the interior locking actuator from the unlocked position toward the locked position and the interior locking actuator is manually rotated relative to the interior handle to move the interior locking actuator from the unlocked position toward the locked position and rotate the driver from the unlocked position to the locked position.

3. The lock assembly of claim 2, wherein the retaining member is coupled to the interior locking actuator for movement with the interior locking actuator in the direction from the interior handle toward the exterior handle and for rotation with the interior locking actuator relative to the interior handle.

4. The lock assembly of claim 1, wherein the interior locking actuator is rotated approximately 90 degrees relative to the interior handle to move the interior locking actuator between the locked and unlocked positions.

5. The lock assembly of claim 1, wherein the biasing member is a first biasing member that rotates the interior locking actuator relative to the interior handle from the locked position toward the unlocked position, the lock assembly further comprising a second biasing member that pushes the interior locking actuator in a direction from the exterior handle toward the interior handle to move the interior locking actuator from the locked position toward the unlocked position.

6. The lock assembly of claim 5, wherein the first biasing member includes a torsion spring, and wherein the second biasing member includes a coil spring.

7. The lock assembly of claim 5, wherein the first biasing member and the second biasing member are located within the interior spindle.

8. The lock assembly of claim 1, wherein the biasing member is located within the interior spindle.

9. The lock assembly of claim 1, further comprising a lock cylinder configured to receive a key, wherein the driver is coupled to the lock cylinder such that rotation of the key rotates the driver from the locked position toward the unlocked position.

10. The lock assembly of claim 1, further comprising a chassis and a locking member that interconnects the exterior handle and the chassis when the driver is in the locked position such that the exterior handle is inoperable to retract the latch when the driver is in the locked position.

11. The lock assembly of claim 10, further comprising a cam member coupled for rotation with the driver, and wherein the cam member moves the locking member along the driver into and out of engagement with the chassis.

12. A lock assembly for use with a latch movable from an extended position to a retracted position, the lock assembly comprising:

an interior handle manually operable to move the latch from the extended position to the retracted position;

an interior locking actuator located on an exterior of the interior handle, the interior locking actuator manually movable from an unlocked position to a locked position;

a biasing member that biases the interior locking actuator toward the unlocked position;

a retaining member that retains the interior locking actuator in the locked position against the bias of the biasing member;

an exterior handle;

a driver rotatable from a locked position to an unlocked position such that the exterior handle is manually operable to retract the latch when the driver is in the unlocked position and the exterior handle is inoperable to retract the latch when the driver is in the locked position; and an interior spindle rotatable with the interior handle to move the latch from the extended position to the retracted position, wherein the interior locking actuator is manually pushed and manually rotated to move the locking actuator from the unlocked position to the locked position, wherein when the interior locking actuator is in the locked position, movement of the interior handle to retract the latch causes the biasing member to move the interior locking actuator toward the unlocked position, wherein the retaining member engages the interior locking actuator and the interior spindle to retain the interior locking actuator in the locked position, wherein rotation of the interior handle disengages the retaining member from the interior locking actuator and the interior spindle to allow the biasing member to move the interior locking actuator toward the unlocked position, wherein the interior spindle includes an aperture, and wherein the retaining member extends into the aperture of the interior spindle to retain the interior locking actuator in the locked position.

13. The lock assembly of claim 12, wherein the interior spindle contacts the retaining member and rotation of the interior spindle pushes the retaining member out of the aperture of the interior spindle to disengage the interior locking actuator and the interior spindle to allow the biasing member to move the interior locking actuator toward the unlocked position.

14. A lock assembly for use with a latch movable from an extended position to a retracted position, the lock assembly comprising:

an interior handle manually operable to move the latch from the extended position to the retracted position;

an interior locking actuator located on an exterior of the interior handle, the interior locking actuator manually movable from an unlocked position to a locked position;

a biasing member that biases the interior locking actuator toward the unlocked position;

a retaining member that retains the interior locking actuator in the locked position against the bias of the biasing member;

an exterior handle;

a driver rotatable from a locked position to an unlocked position such that the exterior handle is manually operable to retract the latch when the driver is in the unlocked position and the exterior handle is inoperable to retract the latch when the driver is in the locked position; and an interior spindle rotatable with the interior handle to move the latch from the extended position to the retracted position, wherein the interior locking actuator is manually pushed and manually rotated to move the locking actuator from the unlocked position to the locked position, wherein when the interior locking actuator is in the locked position, movement of the interior handle to retract the latch causes the biasing member to move the interior locking actuator toward the unlocked position, wherein the retaining member engages the interior locking actuator and the interior spindle to retain the interior locking actuator in the locked position, wherein rotation of the interior handle disengages the retaining member from the interior locking actuator and the interior spindle to allow the biasing member to move the interior locking actuator toward the unlocked position, and wherein the retaining member includes a tab and a biasing member that biases the tab into engagement with the interior spindle to retain the interior locking actuator in the locked position.

15. A lock assembly for use with a latch movable from an extended position to a retracted position, the lock assembly comprising:

a driver rotatable from a locked position to an unlocked position;

an exterior handle manually operable to move the latch from the extended position to the retracted position when the driver is in the unlocked position and inoperable to move the latch when the driver is in the locked position;

an exterior locking actuator coupled to the driver, the exterior locking actuator operable to rotate the driver from the locked position toward the unlocked position;

an interior handle manually operable to move the latch from the extended position to the retracted position;

an interior locking actuator coupled for rotation with the driver and the interior locking actuator manually movable from an unlocked position to a locked position and operable to rotate the driver from the unlocked position to the locked position;

a first biasing member that biases the interior locking actuator in a direction from the exterior handle toward the interior handle;

a second biasing member that rotationally biases the interior locking actuator with respect to the interior handle toward the unlocked position; and a retaining member that retains the interior locking actuator in the locked position against the bias of the first biasing member and the bias of the second biasing member, wherein rotation of the driver from the locked position to the unlocked position by the exterior locking actuator disengages the retaining member such that the first biasing member moves the interior locking actuator in the direction from the exterior handle toward the interior handle and the second biasing member rotates the interior locking actuator to push and rotate the interior locking actuator from the locked position toward the unlocked position, wherein the first biasing member includes a spring, and wherein the second biasing member includes a spring.

16. The lock assembly of claim 15, wherein rotation of the interior handle disengages the retaining member to allow the first and second biasing members to move the interior locking actuator toward the unlocked position thereby rotating the driver toward the unlocked position.

17. The lock assembly of claim 16, further comprising an interior spindle rotatable with the interior handle to move the latch from the extended position to the retracted position, wherein the retaining member engages the interior locking actuator and the interior spindle to retain the interior locking actuator in the locked position, and wherein rotation of the interior handle disengages the retaining member from the interior locking actuator and the interior spindle to allow the first and second biasing members to move the interior locking actuator toward the unlocked position.

18. The lock assembly of claim 17, wherein the interior spindle is generally cylindrical, and wherein the first and the second biasing members are located within the interior spindle.

19. The lock assembly of claim 16, wherein the interior locking actuator is manually pushed in a direction from the interior handle toward the exterior handle to move the interior locking actuator from the unlocked position toward the locked position and the interior locking actuator is manually rotated relative to the interior handle to move the interior locking actuator from the unlocked position toward the locked position and rotate the driver from the unlocked position to the locked position.

* * * * *